US007891646B2

(12) United States Patent
Terry

(10) Patent No.: US 7,891,646 B2
(45) Date of Patent: Feb. 22, 2011

(54) SYNCHRONOUS POSITIONING FRAME ASSEMBLY MACHINE

(75) Inventor: Clifford Terry, Las Cruces, NM (US)

(73) Assignee: Clifford Terry, P. E., Las Cruces, NM (US)

( * ) Notice: Subject to any disclaimer, the term of this patent is extended or adjusted under 35 U.S.C. 154(b) by 400 days.

(21) Appl. No.: 12/228,173

(22) Filed: Aug. 11, 2008

(65) Prior Publication Data

US 2010/0032878 A1 Feb. 11, 2010

(51) Int. Cl.
*B25B 1/20* (2006.01)

(52) U.S. Cl. ..... 269/41; 269/110; 269/73

(58) Field of Classification Search ..... 269/41, 269/71, 73, 104–118
See application file for complete search history.

(56) References Cited

U.S. PATENT DOCUMENTS

| | | | | | |
|---|---|---|---|---|---|
| 149,425 | A | | 2/1874 | Banks et al. | |
| 840,777 | A | | 1/1907 | Lawson | |
| 1,221,601 | A | | 4/1917 | Rowland | |
| 1,342,891 | A | * | 6/1920 | Bergstrom | 269/109 |
| 1,342,892 | A | * | 6/1920 | Bergstrom | 269/110 |
| 1,612,299 | A | * | 12/1926 | Madsen | 269/110 |
| 2,417,144 | A | * | 3/1947 | Trimble | 269/41 |
| 3,590,458 | A | | 7/1971 | Day | |
| 4,047,710 | A | | 9/1977 | Wilson | |
| 4,163,547 | A | | 8/1979 | Jerome | |
| 4,168,825 | A | | 9/1979 | Primmer | |
| 4,211,391 | A | | 7/1980 | Strasser | |
| 4,572,420 | A | | 2/1986 | Pistorius | |
| 4,830,257 | A | | 5/1989 | Lin | |
| 4,909,892 | A | * | 3/1990 | Quinn et al. | 156/499 |
| 6,367,788 | B1 | * | 4/2002 | Babchuk | 269/45 |
| 6,829,972 | B2 | * | 12/2004 | Chen | 83/761 |
| 6,954,979 | B2 | | 10/2005 | Logan | |
| 7,690,631 | B2 | * | 4/2010 | Rathjen | 269/296 |
| 2010/0032878 | A1 | * | 2/2010 | Terry | 269/41 |

* cited by examiner

*Primary Examiner*—Lee D Wilson

(57) ABSTRACT

A Synchronous Positioning Frame Assembly Machine having a plurality of extension wings (48) arranged to precisely locate miter clamps (40) containing captive sliding rails (46) that create a secondary motion to connect small and large frame members. Artist canvas frames, picture frames and other rectangular or square frames such as mirror frames made from mitered members being joined with glue or other mechanical means are precisely brought together at right angles and in a flat plane. Rotary motion of a central rotating shaft (54) linked (50) to the sliding rails (46) positions the clamps (40). A mechanically or manually operated torque lever (56) with knob (58) provides the prime mover force that moves the clamps in a synchronized manner while applying a clamping force to hold the frame members A, B, C, D together with a ratchet (68) and pawl (88) stop for the required assembly time of glue cycle, manual or mechanical fasteners.

20 Claims, 6 Drawing Sheets

SYNCHRONOUS POSITIONING FRAME ASSEMBLY MACHINE

CROSS REFERENCE TO RELATED APPLICATIONS

Not Applicable

FEDERALLY SPONSORED RESEARCH OR DEVELOPMENT

Not Applicable

FIELD OF INVENTION

The present invention relates to a frame-clamping machine with extension wings providing a large flat work area that joins frame members into rectangular or square frames. The machine has moveable sliding rails within the plurality of extension wings that synchronously position clamps to securely fasten frames together for artist's paintings, museum wrap canvas, picture frames, mirrors, frames for cabinet doors, and other frames that need to be clamped precisely together at right angles.

BACKGROUND OF THE INVENTION

A number of devices currently used in the construction of frames are designed mainly for small to medium sizes. Many of which deal with only two of the frame members at a time, securing one corner of the frame and then the next, until all four members have been joined together. The holding platform of these devices for larger frames is too small and causes some difficulty of achieving flatness and making square right angles. These devices require a large table workspace and suitable support in joining the final sections of large frames together, especially over 3 feet in size.

DISCUSSION OF PRIOR ART

Tightening Belt Loops

Devices that use the approach of surrounding the frame with various corner pieces inserted in a loop drawn tightly around the frame are limited to small size frames. A number of clamping means similar to this are demonstrated with patents, Strasser U.S. Pat. No. 4,211,391, Jul. 8, 1980, Jerome, U.S. Pat. No. 4,163,547, Aug. 7, 1979 and Wilson U.S. Pat. No. 4,047,710, Sep. 13, 1977. For larger frames, like those requiring artist's museum wrap canvas over 3 feet or greater, this approach presents many problems dealing with very lengthy belts, manually trying for square to produce right angles and requires very large table surfaces to maintain flatness.

Exterior Corner Clamps

Additional prior art using clamping methods drawing the frame members together from their exterior corner are illustrated with Primmer, U.S. Pat. No. 4,168,825, Sep. 25, 1979, Lawson, 540,777, Jan. 8, 1907 and Banks and Seger, 149,425 Feb. 26, 1874. These concepts experience "racking" problems where the frames tend to create parallelograms and need constant attention of trying for square. They are designed for small frame sizes and lack the support required to maintain flatness and squareness with larger frames.

Concepts with a Plurality of Clamps

Similar concepts utilizing screw clamps at the corners, illustrated with Day U.S. Pat. No. 3,590,458, Jul. 6, 1971, Madsen, U.S. Pat. No. 1,612,299, Jul. 2, 1924 and Rowland, U.S. Pat. No. 1,221,601, Apr. 3, 1917 require a great amount of manual attention at each joint. They also require the necessity of trying the right angles with a square to independently adjust the frame members with as many as 8 clamps. The Day concept, in addition to the many screw clamps required to adjust, has extension arms and a secondary rider motion but it must be adjusted at each corner when trying for square very similar to the Roland principle, which does have a lever with a two-piece table forming a ratchet. The similar screw clamps of the Madsen concept are independent and require manual adjustment to achieve right angles forming a square.

Joining with "V" Nails

Prior art of joining frames with "V" nails has been defined in a number of patents. Three of them, Logan U.S. Pat. No. 6,954,979, Oct. 18, 2005, Pistorious U.S. Pat. No. 4,572,420, Feb. 25, 1986 and Lin U.S. Pat. No. 4,830,257, May 16, 1989 are referenced to demonstrate the means of applying the art to this invention. These patented devices fasten two members of a frame together with "V" nails. The operation is repeated four times until all four corners have been joined together. In this approach all frame members are not in position at one time in a flat plane and holding surfaces are too small for large frames. Additional leveling devices are required to further support the frame members while being fastened together.

OBJECT AND ADVANTAGES

The object of the invention is to provide a frame positioning and clamping table of reasonable size to assemble small and large rectangular frames of any aspect ratio, as well as square frames, while eliminating manual intervention of wrapping belts around the frame, trying for square, and adjusting screw clamps to achieve a right angle.

Synchronous Motion of Clamps

Another object of the invention is to provide a synchronous motion of four clamps acting upon frame members of a large range of sizes precisely bringing them together, forming proper right angles to join them at the corners, while keeping all members on a flat plane.

Applying Clamping Force

Still another object of the invention is to provide a simplistic means of applying the necessary clamping force to hold and join the materials. This is accomplished with a centralized rotary motion by moving a torque lever, which is checked in position with a ratchet. Moving a lever by hand or other mechanical force applied to the rotating shaft or lever provides the rotating force. This eliminates the need for handling a long strap around all the members or tightening individual screw clamps also checking for square and adjusting frame members to produce a right angle.

Space Saving Advantage

An additional object of the invention offers space saving storage when not in use through removal of the extension wings and tabletop drive assembly. This permits use of the moveable table and stand for other purposes and greatly reduces the space required for large tabletops that are needed with other methods previously discussed. The stand, upon which the table surface is mounted, is sturdy to avoid tipping over and may be mounted upon casters, providing easy means of moving about, loading, rotating or positioning and offers storage for the parts removed.

All the further objects of the invention will become apparent upon reading the following description that explains the functions related to the illustrations of the embodiments of the invention.

SUMMARY OF THE INVENTION

The synchronous motion of the assembly machine has adjustable miter clamps that have plural grooved pins, which attach into key slots in captive rails that are guided within extension wings. They are placed at size related positions to receive the frame members to be assembled. The frame members are placed upon the clamps without having to deal with belts, corner inserts or screw clamp adjustments. The miter clamps rotate to provide right angles relative to the aspect of frame length and width and maintain position for repeated assembly of a related frame size. The slide rails are linked together and equally move to a smaller rectangle or square simultaneously moving the miter clamps an equal distance. This brings the frame joints together without the need of trying for square and adjusting various screw clamps. Motion and force is accomplished by moving the torque lever until the pawl retains shaft motion under the applied load. All frame corners or joints are moved into position and the needed force to form each joint is applied and held until the joining method has been completed.

LIST OF REFERENCE NUMERALS

40 MITER CLAMP
42 MITER LOCK
44 MITER GUIDE
46 SLIDE RAIL
48 EXTENSION WINGS
50 LINKS
52 ROTATING DISK
54 ROTATING SHAFT
56 TORQUE LEVER
58 KNOB
60 MOUNTING TABLE
62 SPACER
64 PUSHMASTER INSERTER
66 BOLT
68 RATCHET
70 SHOULDER SCREW
72 LOCKNUT
74 RIVET
76 BLOCK
78 DOWEL PINS
80 NUT
82 GROOVE PIN
84 STAND
86 SHAFT SCREW
88 PAWL
90 SHOULDER PIN
92 SPRING
94 CAM
96 KEY
98 CAM LEVER
100 MANUAL INSERTING TOOL

Figure 1:
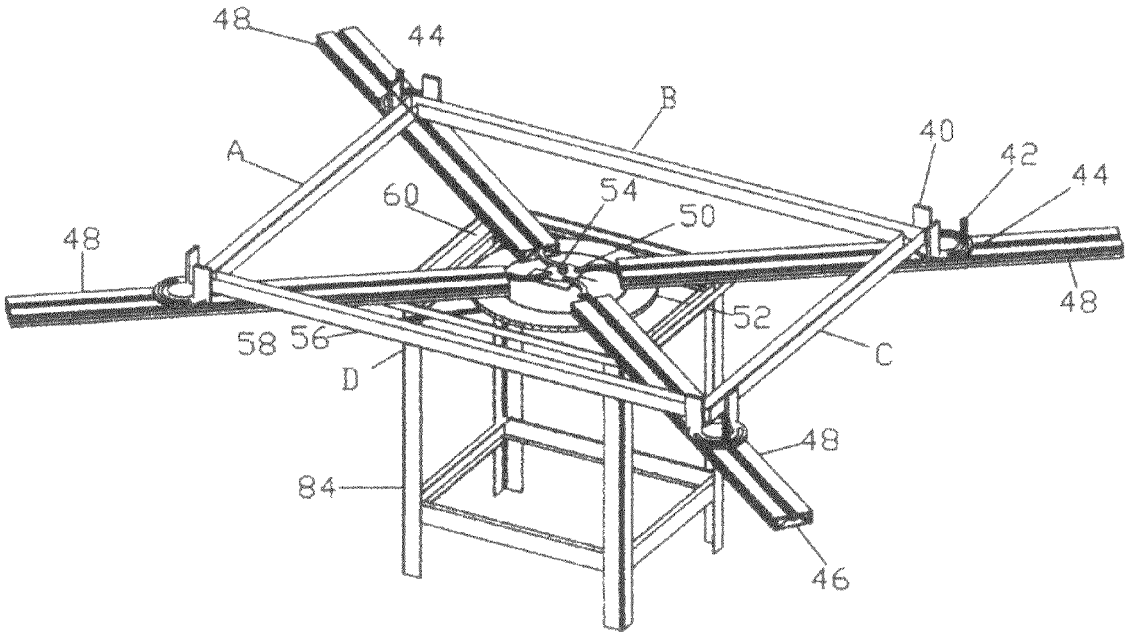
FIG. 1 is a perspective view of my invention supported with a stand showing a frame resting upon the miter clamps and the plurality of wings on the mounting table

FIG. 1 Detailed Description of the Invention

Referring to the drawings, FIG. 1 is the top view of the Synchronous Positioning Frame Assembly Machine showing four moveable miter clamps 40 that bring the referenced frame members A, B, C, D together for permanent joining. These miter clamps 40 bring all frame members together simultaneously forming right angles by virtue of the miter guide 44 moved by the slide rail 46. These clamps are adjustably attached with groove pins 82 affixed to the miter guides 44 that fit into the keyholes of the slide rails 46 and are captive within the plurality of a fixed, rotatable, extension wing 48. The wings are pivotally fastened to a mounting table 60 with a bolt 66 and a locknut 72. The table 60 provides the bearing for a rotating shaft 54, a cam 94 and shoulder pin 90. The slide rails 46 are linked 50 to a central rotating disk 52 driven by the rotating shaft 54. Applying torque to the rotating shaft 54 with a torque lever 56 and knob 58, located under the mounting table 60, rotates the shaft. The links 50 are used to pull the slide rails 46, guided in the extension wings 48, toward the center when the shaft is rotated. The slide rails 46 of each wing 48 are all linked to the rotating disk 52 causing each miter clamp 40 to move in unison, thus drawing the frame members together. All of which are supported with a stand 84.

Figure 2:
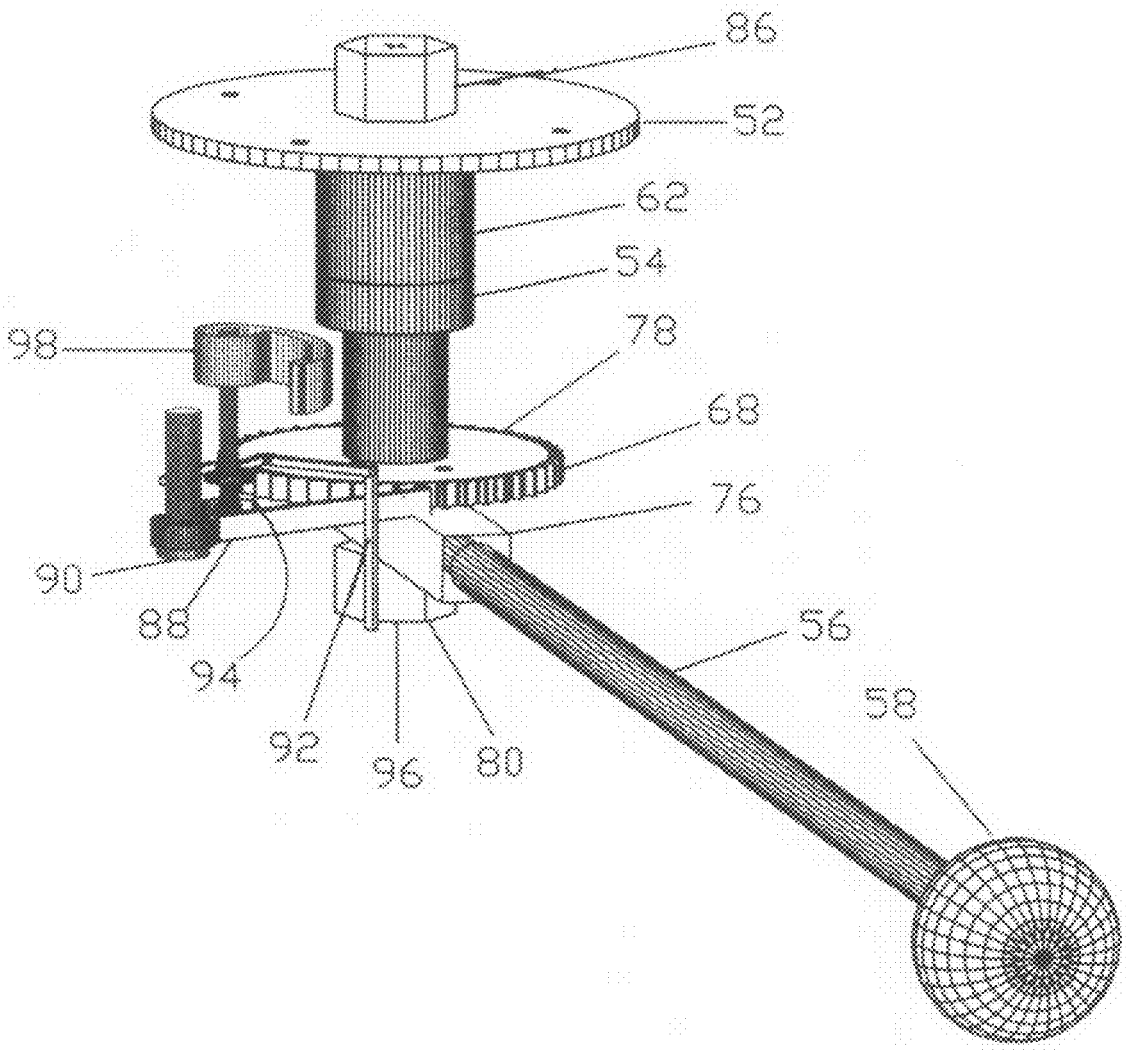
FIG. 2 is a perspective view of the central embodiments of the motion train removed from the table top and its bearing bores that support them.

FIG. 2 Description Of Prime Mover Embodiments

The main embodiments developing the rotary motion to drive the linkages are shown in FIG. 2 where torque lever 56 is fastened to the main rotating shaft 54 by means of a block 76, key 96 and dowel pins 78 that engage with ratchet 68 and the rotating shaft 54. The rotating shaft 54 has stepped diameters and is fastened to the table with nut 80. A spacer 62 and the rotating disk 52 are attached with a shaft screw 86, which permits their removal from the upper portion above the mounting table. A pawl 88 is captive in shoulder pin 90 and a spring 92 loads it against ratchet 68. A cam 94 is rotated with cam lever 98 above the mounting table and it rotates pawl 88 away from ratchet 68 to free the main rotating shaft 54 for reverse motion. Moving the torque lever 56 in the opposite direction releases the force and moves the miter clamps 40 away from the frame.

Figure 3:
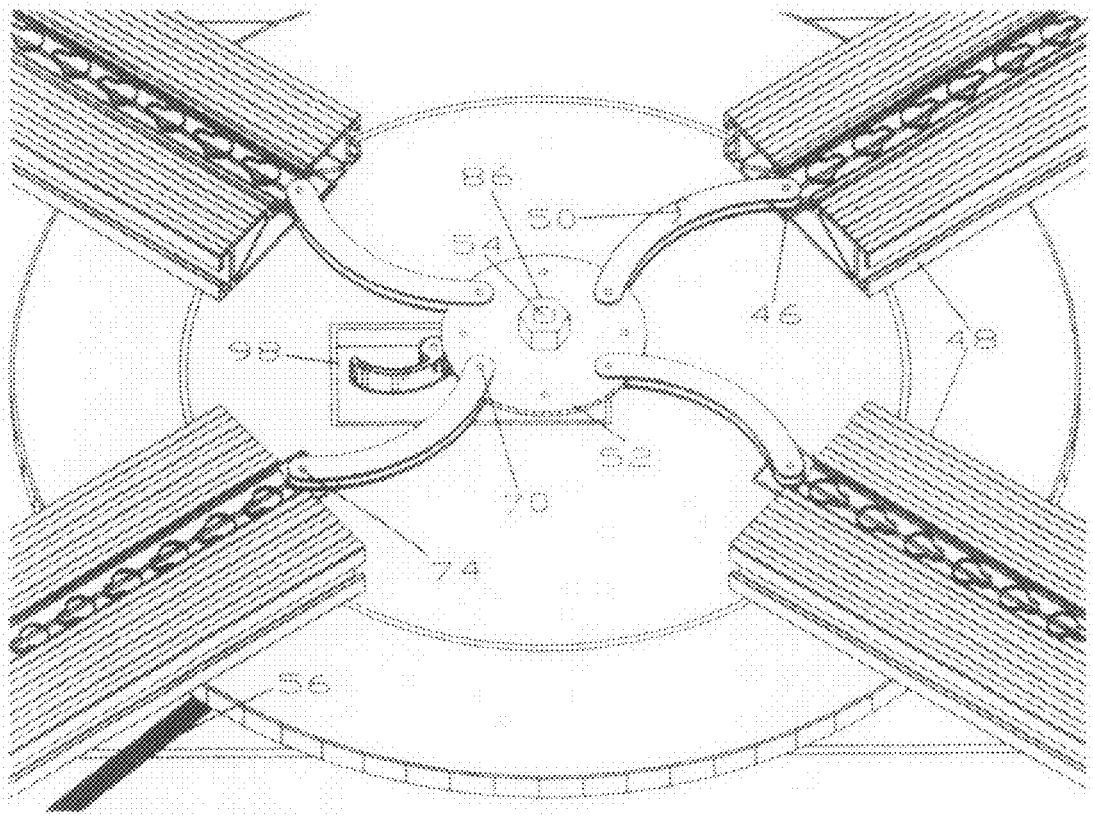
FIG. 3 is a frontal perspective view of the linkage showing the retracted position of the sliding rails with the torque lever on the left and cam release lever.

FIG. 3 Description Of Linkage Motion, Retracted

A close-up of the slide rails 46 captive in the guide grooves of extension wings 48 is shown in FIG. 3; in their retracted state. The links 50 are riveted 74 to the slide rails 46 and the opposite ends pinned 70 to the rotating disk 52. A shaft screw 86 fastens the rotating disk 52 and a spacer 62 shown in FIG. 2, to the rotating shaft 54 while the extension wings 48 pivot on a bolt 66 and permit rotation for aspect adjustment.

Figure 4:
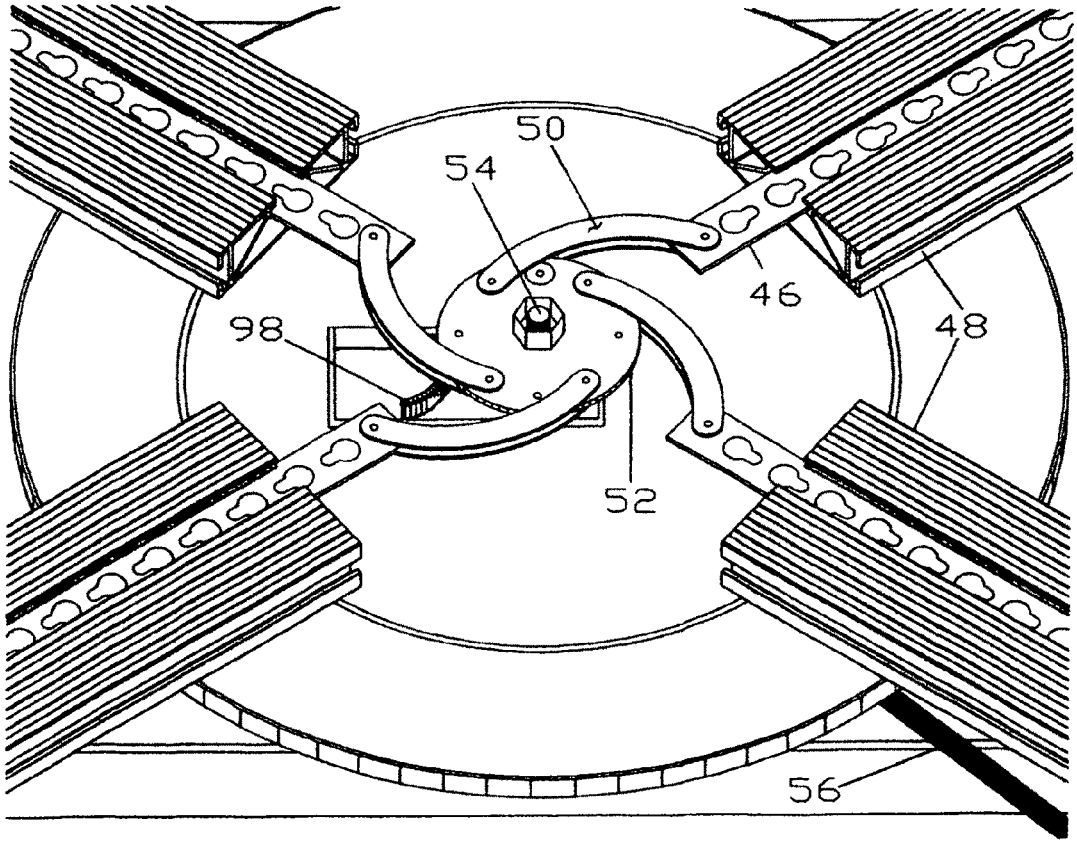
FIG. 4 is a frontal perspective view demonstrating the linkage rotated 90 degrees and the forward position of the sliding rails as they are moved in unity toward the center of the table with the torque lever moved to the right and cam lever in ratchet position.

FIG. 4 Description Of Linkage Motion, Extended

The rotating shaft 54 and rotating disk 52 have been moved by the torque lever 56 In FIG. 4 through an arc of about 90 degrees. The links 50 have extended the slide rails 46, miter guides 44 and miter clamps 40 shown in FIG. 5, which force the frame members A, B, C, D together at their joints.

Figure 5:
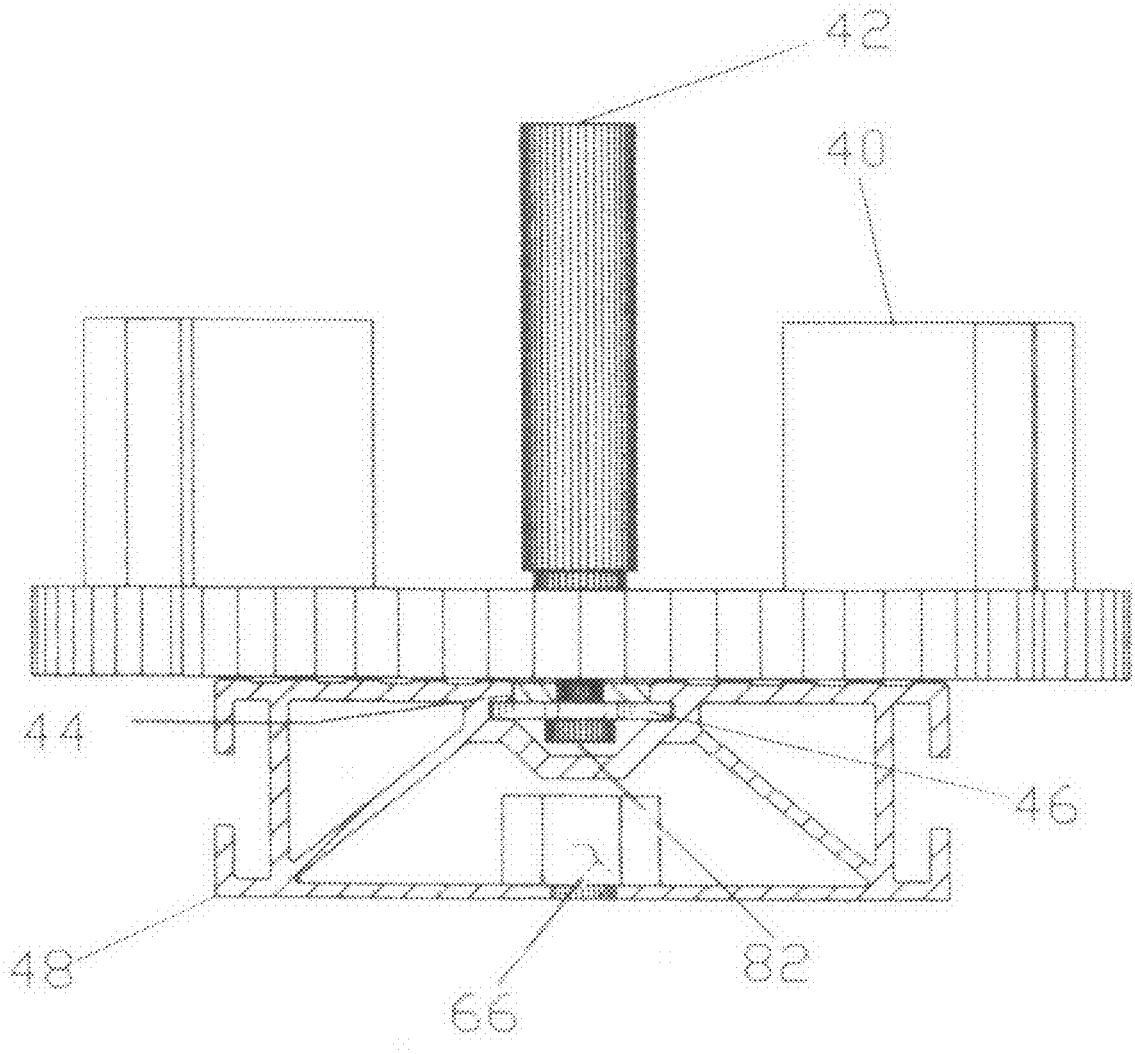
FIG. 5 is a detail cross section of the extension wing showing the sliding rail with the miter guide, its grooved pins engaged into the key slots of the sliding rail, showing how the miter clamp and its rotation locking handle are attached for various sizes of frames.
Figure 6:
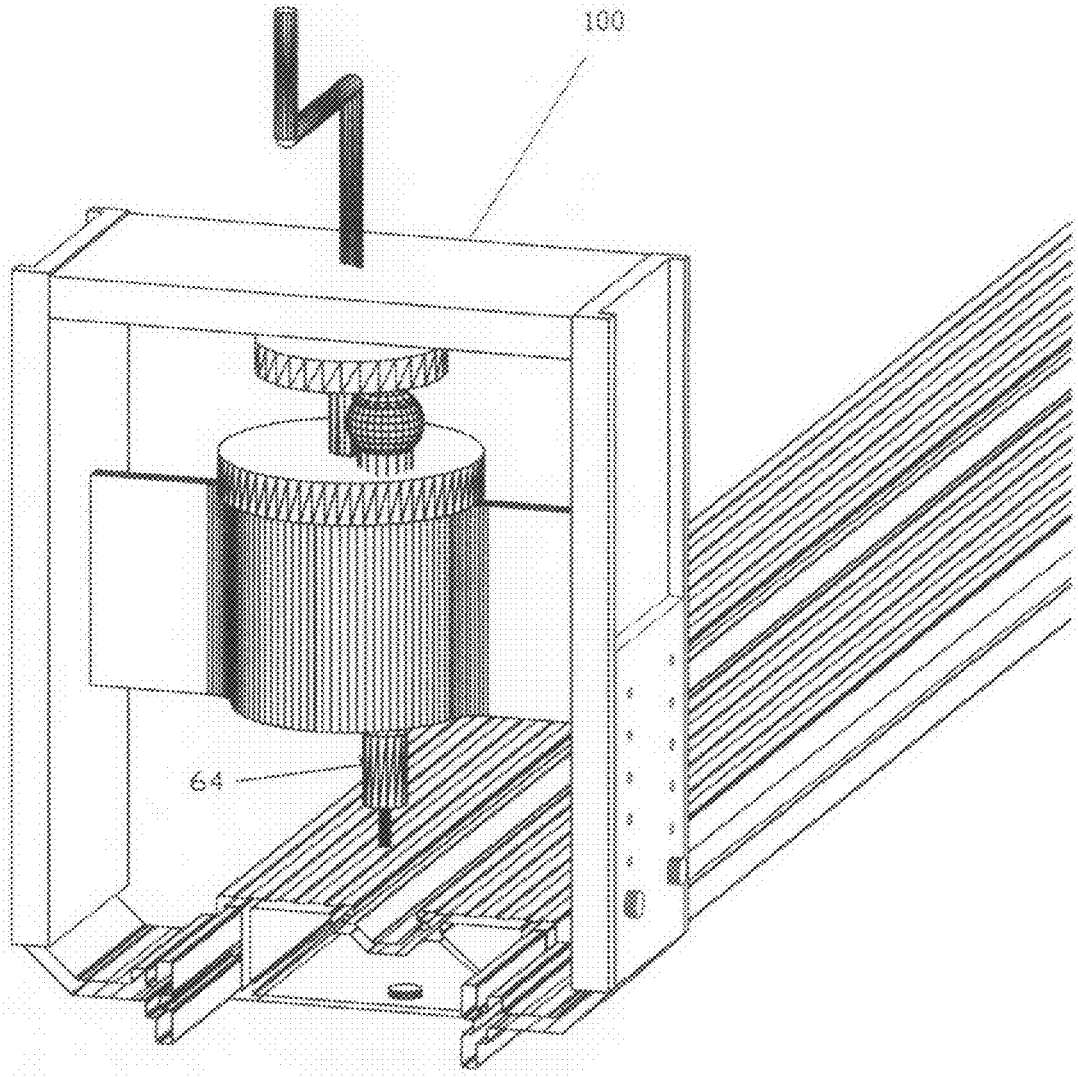
FIG. 6 shows the Optional Manual Inserting Tool 100 using the "Pushmaster" spring loaded V-Nail inserter placed in an orbital barrel supported in a frame and attached to a wing in its plural outboard grooves provided.

FIG. 5 Description Of Miter Clamp Attachment

FIG. 5 is a view that shows the miter clamp 40 and miter guide 44 attached to the slide rail 46 with its grooved pins 82 engaged in a linear array of keyhole slots in the slide rail 46. The miter guide 44 is further guided in the ways within extension wings 48. All of this permits positioning of the miter clamp 40 for any frame aspect ratio and size as well as locking the needed clamp rotation with miter lock 42, which establishes a right angle at the frame joints/corner's.

OPERATION OF THE INVENTION

With the machine elements assembled, the setup for Manual operation of the machine is easily accomplished by affixing the miter guide 44 groove pins 82 into the keyhole slots of the slide rail 46 at a desired frame size location indicated at each extension wing 48. The frame members are placed upon the miter clamps 40 with the miter lock 42 loosened and the torque lever 56 retracted. When the torque lever 56 is moved the frame joints be brought together. Upon closing the miter joints of the frame members A, B, C, D, the miter lock 42 is tightened and the needed torque is applied for the rotating shaft 52 to be held in place by pawl 88 and ratchet 68 until the glue cycle is completed or the joints are fastened by other means. On completing the joint attachment, a slight force is applied to the torque lever 56 to release the load on pawl 88 until the cam 95 is rotated to the release position with cam lever 98 and the torque lever 56 fully retracted. This simultaneously moves the miter clamps 40 away from the frame's corners maintaining support for the frame in the flat plane on the miter clamp 40 surfaces until it is removed from the assembly machine.

Glue Joints

If the joints are mitered and directly glued or strengthened with the addition of inserts such as biscuits, glue is applied while the joints are open and biscuits inserted (if used). The clamps are relieved providing space for excess glue removal at each joint. Next, with the cam handle in the released position the torque lever 56 is pulled until all parts are together forming right angles. The miter locks 42 are tightened to maintain the developed angle position and to apply equal force to the frame members. Upon removing excess glue, the cam lever 98 is rotated to permit the cam 94 to engage the pawl 88 with the ratchet 68 and torque is applied with the torque lever 56. When the desired force is applied to the frame members the pawl 88 retains the loaded position at the ratchet 68 until the glue has set and the operator moves the cam lever 98. This lever rotates the cam 94 to release the pawl 88 from the ratchet 68 returning the torque lever 56 to its original position moves the miter clamps 40 away from the ram corners. The completed frame rests upon the miter clamps 40 in a flat plane until removed from the machine.

Nail joints

For Frames that require simple nails for joining from the outside of each corner the same procedure to bring the joints together as accomplished with glue joints is used. Upon reaching the required force position with the pawl 88 and ratchet 68 holding the position, nails are hammered into the frame member corners at each miter clamp. Miter clamps 40 have clearance areas providing space for hammering nails while the frame is clamped.

"V" Nails

When assembling frames with V Nails it is necessary to use the optional manual inserting tool 100. This tool uses a similar "magnetic post" cited with a patent by Lin, U.S. Pat. No. 4,572,420, Feb. 25, 1986 named the "Pushmaster", 64 to hold the V-Nail. The optional manual inserting tool is positioned along the extension wings at the outer groove locations provided. By locking it at its proper rotation prior to loading the V-Nail into the magnetic holder and rotating the crank used to move the Pushmaster and apply force to insert the V nail into the frame joint. Repeating the operation at a second desired location of each joint by rotating the lever to fully insert the V-nail flush to the frame surface.

Other Use of the Table and Stand

The stand 84, which forms the main frame for this machine, in addition to its legs, has lower and upper side supports, which have a multiple purpose when the machine is not in use. Additional to being a structural member, the bottom side supports are used to store the extension wings 48 containing the slide rail 46, the miter clamp assemblies 40 and links 50. This greatly reduces required floor space and permits use of the mounting table and stand as a worktable for other purposes after removal of the rotating disk 52 spacer 62, retained with the shaft screw 86. The links 50 are disconnected from the disk 52 with the removal of the shoulder screw 70 and are also stored in the lower frame support. The main rotating shaft 54 and cam release lever 98 are recessed below the table surface thus providing a sturdy, flat work surface.

CONCLUSION, RAMIFICATIONS AND SCOPE OF INVENTION

Thus the reader will see that a machine with extension wings having motion control linked within them provides a reliable and accurate means of joining frames of any size and assuring they are assembled in a flat plane. While the above explanations contain many descriptive details of the machine, these should not be construed as limitations on the scope of the invention but rather an exemplification of the preferred embodiments thereof. Additional variations of use are possible particularly with the application of pneumatic power to operate the main rotating shaft; additional special tooling to pneumatically feed and drive "V" nails and nail drivers stationed at the frame's corners. Thus semi-automated factory assembly of all frame joints at once becomes possible with the use of the preferred embodiments.

I claim:

1. A synchronous positioning frame assembly system for assembly frames said system comprising a plurality of extended pivoting wings each rotatingly attached upon a mounting means aligning the wings for clamping square and rectangular frame patterns; said wings containing sliding captive rails linked with aperture within a rotating plate attached to a central arbor rotated with a torque lever causing said rails to move inward or outward wherein said rails having a plurality of equally spaced keyholes in an linear array to precisely move in unison in response to said torque lever such that pivoting miter clamps selectively located along each of said rails synchronously moving said miter clamps and conventional frame joints together in a flat plane forming right angles at each of the corners with sustaining force for gluing and mechanical fastening of the frame members all of which is mounted upon a supporting structure.

2. The synchronous positioning assembly system as in claim 1 wherein said wings have a thin wall rectangular shape.

3. The synchronous positioning assembly system as in claim 2 wherein said wings are made of said rectangular shaped metal extrusions comprising grooves for sliding members.

4. The synchronous positioning assembly system as in claim 2 wherein said grooves are longitudinally located on three sides of said wings and said rails slide in the main captivating grooves at the a top wide side of said rectangle.

5. The synchronous positioning assembly system as in claim 4 wherein said wings have additional longitudinal grooves at opposite narrow sides, run the entire length of said wings and mount a manual inserting tool used for mechanical attachment of frame members.

6. The synchronous positioning assembly system as in claim 5 wherein said manual inserting tool is further comprising a fixture including a crank handle, a magnetic holder, and a pushing mechanism for holding a "V" nail installing said "V" nail in said frame members.

7. The synchronous positioning assembly system as in claim 1 wherein said miter guides having a plurality of groove pins that engage into said keyholes of said rails are coordinated with an incorporated hole to register a boss on the underside of said miter clamps.

8. The synchronous positioning assembly system as in claim 7 wherein said miter clamps pivot about the centerline of said boss on the underside which is coordinated with a point representing the apex of the right angle planes of the clamp faces that is the outward point of the frame members to be joined.

9. The synchronous positioning assembly system as in claim 8 wherein said cross members support said wings when removed from the table.

10. The synchronous positioning assembly system as in claim 7 wherein said clamp faces extend upward at 90 degrees on the opposite side from said boss for a short length along a 45 degree plane on both sides of the longitudinal centerline of said miter clamp commencing a short distance from said apex allowing some exposure of said frame members near the outermost point for access of mechanical fastening.

11. The synchronous positioning assembly system as in claim 10 wherein said miter clamps have a relief groove along the centerline between the clamp faces such that a space is provided for excess glue runoff from said frame members.

12. The synchronous positioning assembly system as in claim 10 wherein said miter clamps have a radial slot for clearance of a shaft with a knob threaded into said miter guide to lock the rotational position of said miter clamp.

13. The synchronous positioning assembly system as in claim 10 wherein said ratchet permits a sustained compression force applied to said frame members when said miter clamps bring them into contact.

14. The synchronous positioning assembly system as in claim 10 wherein a cam adjacent to said pawl rotates it clear of said ratchet when moved by a cam lever and counter rotation of said arbor simultaneously moves said miter clamps through said fixed synchronous linkeage in a linear plane away from said arbor centerline and from said frame members.

15. The synchronous positioning assembly system as in claim 1 wherein said arbor, said disk, and the plurality of said links, said rails, said miter guides and said miter clamps are dimensionally coordinated to said arbor's centerline such that said miter clamps positioned at one set of said keyholes on any rail will be at the same dimension on each of said rails forming a fixed synchronous linkeage operating within a square.

16. The synchronous positioning assembly system as in claim 15 wherein said fixed synchronous linkeage may operate within a rectangle when said wings are repositioned on the table at a rectangular pattern of holes and said links attached to said disk at a rectangular pattern.

17. The synchronous positioning assembly system as in claim 15 wherein said fixed synchronous linkeage brings said frame members together forming 90 degree right angles at each corner of said square pattern or said rectangular pattern.

18. The synchronous positioning assembly system as in claim 1 wherein a ratchet engaging its teeth with a spring loaded pawl retains the radial position of said arbor when rotated in the desired direction with said torque lever.

19. The synchronous positioning assembly system as in claim 1 wherein a means of upright supports with cross members horizontally surrounding said uprights provide the support for said mounting table means.

20. The synchronous positioning assembly system as in claim 1 wherein said plate is circular with a plurality of apertures being equally spaced.

* * * * *